US008089501B2

(12) United States Patent
Nagumo

(10) Patent No.: US 8,089,501 B2
(45) Date of Patent: Jan. 3, 2012

(54) LIGHT EMITTING APPARATUS, OPTICAL PRINTHEAD, AND IMAGE FORMING APPARATUS

(75) Inventor: Akira Nagumo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 497 days.

(21) Appl. No.: 12/318,119

(22) Filed: Dec. 22, 2008

(65) Prior Publication Data

US 2009/0167836 A1 Jul. 2, 2009

(30) Foreign Application Priority Data

Dec. 26, 2007 (JP) ..... 2007-334678

(51) Int. Cl.
*B41J 2/435* (2006.01)
*B41J 2/47* (2006.01)

(52) U.S. Cl. ..... 347/247; 347/237; 347/238

(58) Field of Classification Search ..... 347/247, 347/237, 238
See application file for complete search history.

(56) References Cited

U.S. PATENT DOCUMENTS

| | | | | |
|---|---|---|---|---|
| 4,217,618 | A * | 8/1980 | Kellenbenz et al. | 361/56 |
| 4,792,838 | A * | 12/1988 | Hayashi et al. | 327/421 |
| 2001/0010510 | A1* | 8/2001 | Ohno | 345/82 |
| 2007/0057259 | A1* | 3/2007 | Nagumo | 257/67 |
| 2007/0120868 | A1* | 5/2007 | Baek | 345/600 |

FOREIGN PATENT DOCUMENTS

JP 2007-081081 3/2007

* cited by examiner

*Primary Examiner* — Stephen Meier
*Assistant Examiner* — Sarah Al Hashim
(74) *Attorney, Agent, or Firm* — Rabin & Berdo, P.C.

(57) ABSTRACT

A light emitting apparatus includes optical thyristors, a driver circuit that supplies a drive current to the thyristors so that the thyristors emit light, and a control circuit that controls the thyristors. Each thyristor includes an anode, a cathode connected to the ground, and a gate. The thyristor emits light when the drive current flows therethrough. The control circuit controls the gate, causing a control current to flow from the anode to the gate to turn on the thyristors. The control circuit applies a control voltage to the gate, the control voltage being higher than a voltage appearing across the gate and the cathode when the thyristor remains turned on.

8 Claims, 13 Drawing Sheets

LIGHT EMITTING APPARATUS, OPTICAL PRINTHEAD, AND IMAGE FORMING APPARATUS

BACKGROUND OF THE INVENTION

1. Field of the Invention

The present invention relates to a light emitting apparatus, and optical printhead that employs the light emitting apparatus, and an image forming apparatus.

2. Description of the Related Art

A conventional image forming apparatus including an electrophotographic printer performs electrophotographic processes. A photoconductive drum is uniformly charged. The charged surface of the photoconductive drum is selectively exposed to light in accordance with print data to form an electrostatic latent image on the photoconductive drum. The electrostatic latent image is then developed with toner into a toner image. Subsequently, the toner image is transferred onto print paper, and is then fixed. This type of image forming apparatus employs a light source formed of light emitting diodes (LEDs) or light emitting thyristors.

LEDs emit light when current flows from anode to cathode. An LED turns on to emit light when current flows through its anode-to-cathode junction, and turns off not to emit light when current does not flow through the anode-to-cathode junction. When voltage is applied across the anode-to-cathode junction of an thyristor, the thyristor turns on to emit light if voltage is applied to the gate of the thyristor, and turns off not to emit light if voltage is not applied to the gate. Japanese patent preliminary publication No. 2007-81081 discloses one such image forming apparatus that employs a thyristor type optical printhead.

FIG. 13 is the circuit diagram of a conventional optical printhead. Referring to FIG. 13, an optical printhead 19 employs a shift register 30 formed of flip-flops 31-38 and buffers 41-48. Light emitting thyristors T1-T8 each include an anode, a cathode, and a gate.

The optical printhead 19 includes three input terminals: a shift data terminal SI, a shift clock terminal SCK, and a data terminal DATA. The data terminal DATA is connected to the anode of the thyristors. An anode current is supplied into a thyristor through the data terminal DATA, and drives the thyristor. The shift data terminal SI is connected to the D input terminal of the first flip-flop, i.e., flip-flop 31. The Q output terminal of each of the flip-flops 31-38 is connected to the D input terminal of the next flip-flop and to the input terminal of a corresponding buffer.

The output terminal of the buffer 41 serves as an output Q1 of the shift register 30, and is connected to the gate terminal of the thyristor T1. Likewise, the outputs Q2-Q8 of the shift register 30 are connected to the gates of the thyristors T2-T8. The shift clock terminal SCK of the shift register 30 is connected to the clock terminals of the flip-flops 31-38. The data terminal DATA of the optical printhead 19 is connected to the anodes of the thyristors T2-T8. The cathodes of the thyristors T2-T8 are connected to the ground.

FIG. 14 is a schematic diagram of a driver circuit illustrating a plurality of thyristors shown in FIG. 13. FIG. 14A illustrates the flip-flop 31, the buffer 41, and the thyristor T1 of the circuit shown in FIG. 13. An anode current Ia, a cathode current Ik, and a gate current Ig flow in directions shown by arrows, respectively. FIG. 14B illustrates the details of the circuit shown in FIG. 14A, showing the internal configuration of the buffer 41 and the thyristor T1.

Referring to FIG. 14B, the buffer 41 includes a first inverter formed of a PMOS transistor 51 and an NMOS transistor 52, and a second inverter formed of a PMOS transistor 53 and an NMOS transistor 54. Thyristors are devices of PNPN configuration in which a P-type semiconductor layer and an N-type semiconductor layer are stacked alternately one over the other to form a PNPN structure. The equivalent circuit of a thyristor may be expressed by the combination of a PNP 61 transistor and an NPN transistor 62. The emitter of the PNP transistor 61 corresponds to the anode of the thyristor T1, and the base of the PNP transistor 61 corresponds to the gate of the thyristor T1. The gate is also connected to the collector of the NPN transistor 62. The collector of the PNP transistor 61 is connected to the base of the NPN transistor 62. The emitter of the NPN transistor 62 corresponds to the cathode of the thyristor T1, and is grounded.

When the thyristor T1 conducts to emit light, the Q output of the flip-flop 31 is low. At this moment, the PMOS transistor 51 of the buffer 41 is ON, and the NMOS transistor 52 is OFF, so that the first inverter output becomes high. At this moment, the PMOS transistor 53 is OFF, and the NMOS transistor 54 is ON, and the output of the second inverter becomes low.

When the potential of the data terminal DATA increases, the thyristor T1 turns on. The gate current Ig flows in a path shown by dotted line. The gate current Ig is equivalent to the base current of the PNP transistor 61. The gate current Ig causes the PNP transistor 61 to turn on, so that the collector current flows through the PNP transistor 61. This collector current flows into the base of the NPN transistor 62 to cause current Ik1 to flow. The current Ik1 flows into the base of the PNP transistor 61 to ensure that the PNP transistor 61 turns on.

When a predetermined amount of current flows from anode to cathode, the thyristor T1 conducts to emits light. When the thyristor T1 emits light, the NPN transistor 62 is ON, and the voltage across the collector-emitter junction is the collector-emitter saturation voltage Vce(sat). The collector-emitter saturation voltage Vce(sat) is determined by the physical shape of the element, and the collector and base currents flowing through the NPN transistor 62. The Vce(sat) is typically in the range of 0.2 to 0.8 V.

At this moment, the gate voltage of the thyristor T1 is low and a part of the anode current supplied from the DATA terminal flows as the gate current Ig through the buffer 41 to the ground. Assume that the output of the buffer 41 is virtually disconnected from the gate of the thyristor T1. The output voltage $V_{OL}$ of the buffer 41 is determined by the drive capability of the NMOS transistor 54 (i.e., "ON" resistance of the NMOS transistor 54) and the gate current Ig of the thyristor T1. If $V_{OL}$ is lower than Vce (sat), then a part of the anode current that flows through the gate to the NMOS transistor 54 increases, and the collector current Ik2 of the NPN transistor 62 and the collector current Ik1 of the PNPN transistor 61 decrease.

As described above, the typical value of the Vce (sat) of the NPN transistor 62 is in the range of 0.2-0.8 V. The typical value of the output of the inverter constituted by the NMOS transistor 53 and NMOS transistor 54 changes between a value substantially equal to VDD and a value close to the ground potential (0V). Consequently, the NMOS transistor 54 has a greater capability to drive a load than the NPN transistor 62. Therefore, a large portion of the driver current supplied into the anode of the thyristor T1 will not flow into the collector of the NPN transistor 62 but into the NMOS transistor 54 through the gate of the thyristor T1.

If the buffer for driving the gate of a thyristor has a higher drive capability than an NPN transistor in the thyristor, a part of the drive current supplied into the anode terminal will flow into the gate terminal, causing a decrease in the anode-to-cathode current. This decreases light output of the thyristor.

In addition to the drive capability of the buffer to drive the gate of thyristor, fluctuation of the power supply voltage VDD during a printing operation is another factor that leads to changes in light output of the thyristor. The change in light output of the thyristor prominently impairs the print quality.

SUMMARY OF THE INVENTION

An object of the invention is to provide a driver circuit, an optical printhead, and an image forming apparatus capable of increasing the light output of an optical thyristor while decreasing the non-effective, detrimental leakage current through the gate without an excessive decrease in the gate potential.

Another object of the invention is to provide a driver circuit, an optical printhead, and an image forming apparatus in which the gate current of an optical thyristor is reduced to prevent the gate current from fluctuate due to changes in power supply voltage and ambient temperature, thereby providing a print result without uneven density.

A light emitting apparatus includes optical thyristors, a driver that supplies a drive current to the thyristors so that the thyristor emits light, and a control circuit that controls the thyristors. Each thyristor includes an anode, a cathode connected to the ground, and a gate. The thyristor emits light when the drive current flows therethrough. The control circuit applies a control voltage to the gate, causing a control current to flow from the anode to the gate to turn on the thyristors. The control voltage is higher than a voltage appearing across the gate and the cathode when the thyristor remains turned on.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Printer}

Figure 1:
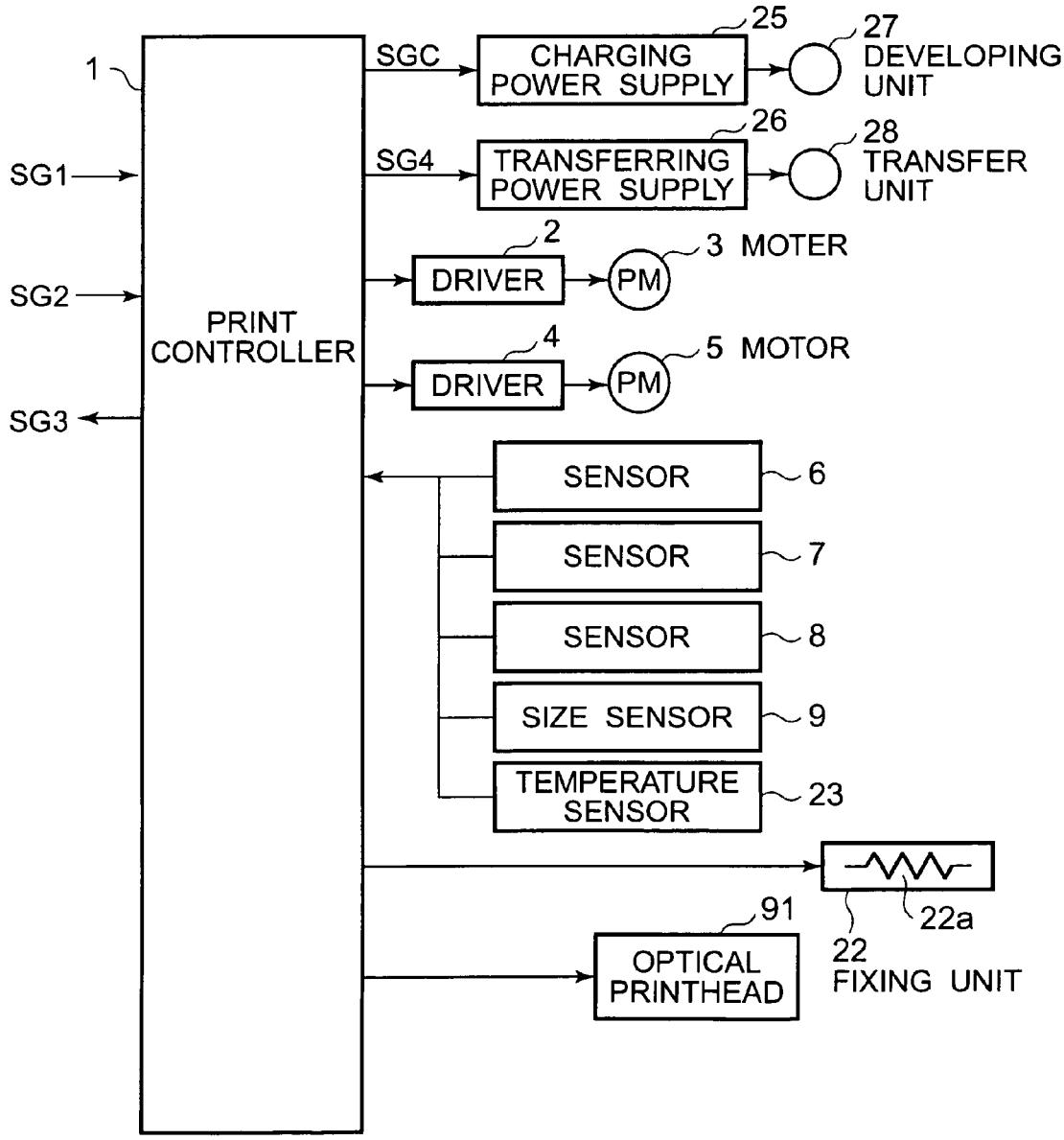
FIG. 1 is a block diagram illustrating an electrophotographic printer of the invention.
Figure 2:
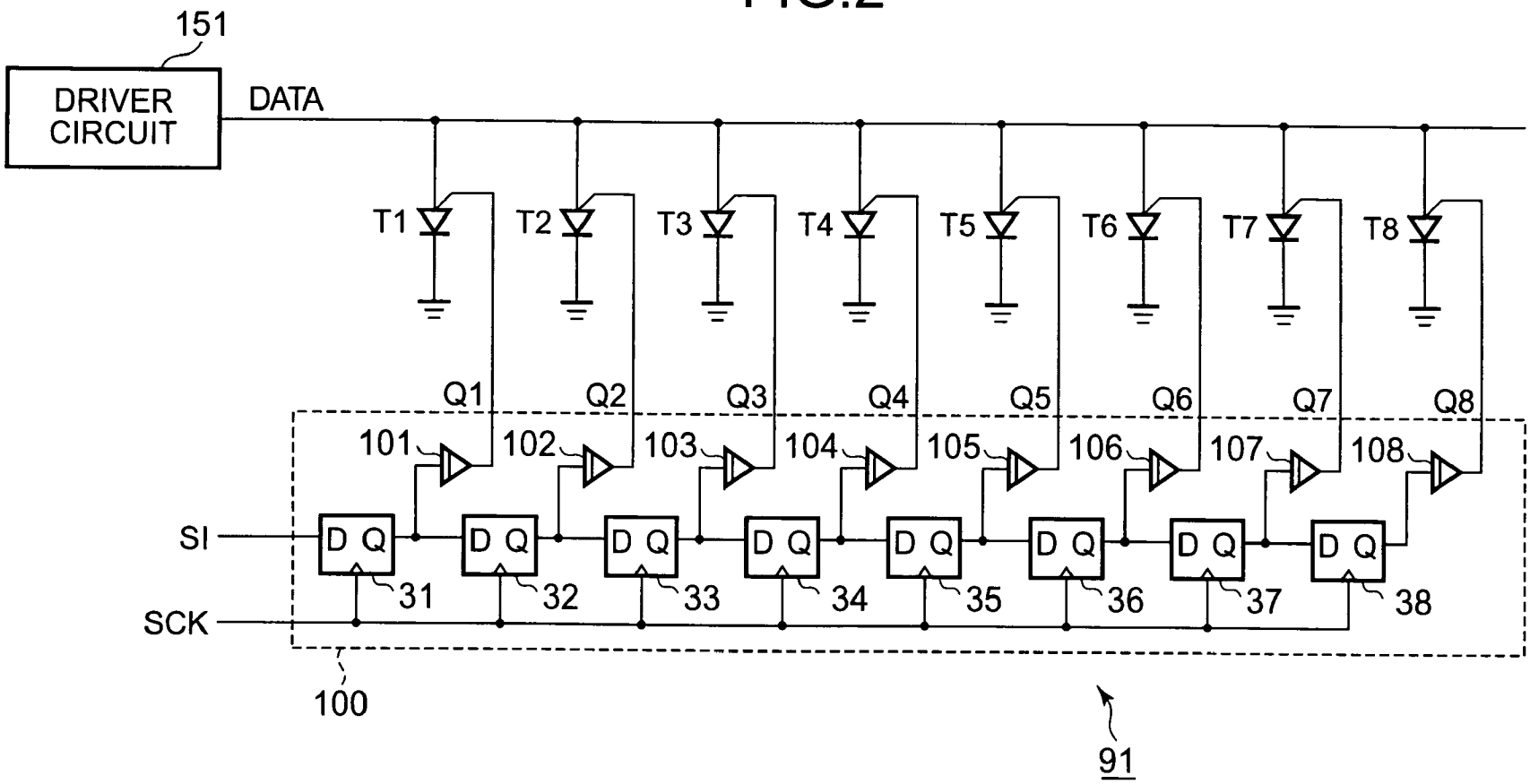
FIG. 2 is a schematic diagram illustrating an optical printhead of a first embodiment.

A first embodiment of the invention will be described with reference to the accompanying drawings. Elements common to the respective figures have been given the same reference numerals. FIG. 1 is a block diagram illustrating an electrophotographic printer of the invention. FIG. 2 is a schematic diagram illustrating an optical printhead 91 of the first embodiment.

Referring to FIG. 1, a print controller 1 primarily includes a micro processor, a ROM, a RAM, an I/O port, and a timer, and resides in a printing section. The print controller 1 performs the overall sequential control of the printer based on a control signal SG1 and a video signal SG2 (a long string of dot map data) received from a host apparatus (not shown) for printing an image.

A fixing unit 22 incorporates a heater 22*a* therein. A temperature sensor 23 detects the temperature of the fixing unit 22. Upon receiving a print command in the form of the control signal SG1, the print controller 1 checks the output of the temperature sensor 23 to determine whether the temperature of the fixing unit 22 is in such a range that a fixing operation may be successfully carried out. If the temperature is not within the range, the heater 22*a* is energized to heat the fixing unit 22 to a temperature at which the fixing unit 22 may normally operate. Then, the print controller 1 causes the driver 2 to drive a process motor 3 to rotate. Concurrently, the print controller 1 provides a charge signal SGC to a charging power supply 25. In response to the charge signal SGC, the charging power supply 25 turns on to charge a developing unit 27.

A paper sensor 8 detects the type and the presence or absence of print paper in a corresponding paper cassette. A size sensor 9 detects the size of the print paper. The print paper is advanced from the paper cassette in a manner appropriate for the type of the print paper. The driver 4 is capable of causing a motor 5 both in a forward direction and in a revere direction. The driver 4 first causes the motor 5 to rotate in the reverse direction to advance the print paper by a predetermined distance until a sensor 6 detects the print paper. Subsequently, the driver 4 causes the motor 5 to rotate in the forward direction to advance the print paper into a print engine.

When the print paper reaches a position where printing may be performed, the print controller 1 transmits a timing signal SG3 (includes a main scan sync signal and a sub scan sync signal) to a host controller, and receives the video signal SG2 from the host controller. The host controller edits the video signal SG2 on a page-by-page basis, and the print controller 1 receives the edited video signal SG2. The received video signal SG2 is then transferred as print data signal HD-DATA to the optical printhead (referred to as printhead hereinafter) 91. The printhead 91 includes a plurality of optical thyristors (referred to as thyristor hereinafter) aligned in a line, each thyristor forming a corresponding dot (pixel).

The video signal SG2 is transmitted and received on a line-by-line basis. The printhead 91 illuminates the negatively charged surface of a photoconductive drum (not shown) in accordance with image data to forms dots, which form an electrostatic latent image as a whole. The light emitted from the printhead 91 dissipates the charges on the photoconductive drum, so that the dots formed on the photoconductive drum are less negatively charged. Toner in the developing unit 27 is charged negatively, and is attracted by an electrostatic field across the photoconductive drum and the developing unit to the dots formed on the photoconductive drum. Thus, the electrostatic latent image is developed with the toner into a toner image.

Then, as the photoconductive drum rotates, the toner image on the photoconductive drum approaches a transfer unit 28. The print controller 1 outputs a transfer signal SG4 that turns on a transferring power supply 26 to output a positive voltage. Upon receiving the positive voltage, the transfer unit 28 transfers the toner image onto the print paper. After transferring, the print paper advances to the fixing unit 22 in which the toner image is fused into the print paper by the heat generated by the heater 22*a*. Then, the print paper is further advanced past a sensor 7 to the outside of the printer.

In response to the detection outputs of the sensors 9 and 6, the print controller 1 causes the transfer power supply 26 to output the voltage to the transfer unit 28 only for a period of time during which the print paper advances past the transfer unit 28. When the print paper advances past sensor 7 after printing, the print controller 1 causes the charging power supply 25 to cease the application of voltage to the developing unit 27 and the rotation of the motor 3. The aforementioned operation is repeated thereafter.

{Printhead}

The printhead 91 will be described in detail. The printhead 91 incorporates thyristors as a light emitting element. A thyristor has a PNPN structure formed of a compound semiconductor (e.g., GaAs, GaP, AlGaAs, InGaAsP, or InGaAlAs), and emits light just as in light emitting diodes (LEDs) and laser diodes (LDs). A silicon controller rectifier (SCR) is another type of thyristor, being made from silicon.

The configuration of the optical printhead 91 will be described with reference to FIG. 2. For simplicity's sake, the printhead 91 shown in FIG. 2 is formed of eight light emitting elements. For example, the number of light emitting elements is 4,992 for a printhead capable of printing 600 dots per inch on A4 size paper.

Referring to FIG. 2, the optical printhead 91 includes a shift register 100 constituted of flip-flops 31-38 and buffers 101-108. Thyristors T1-T8 each include an anode, a cathode, and a gate. The printhead 91 includes three terminals: a shift data terminal SI connected to the shift register 100, a shift clock terminal SCK for the shift register 100, and a data terminal DATA connected to the anode of the thyristor. A driver circuit 151 supplies the anode current to the respective thyristors so that the anode current flows into the respective thyristor through the data terminal DATA to drive the thyristor. The driver circuit 151 may be incorporated either in the optical printhead 91 or in the print controller 1.

The shift data terminal SI is connected to the D input terminal of the flip-flops 31, and the Q output of the flip-flop 31 is connected to the D input terminal of the flip-flop 32 and the input terminal of the buffer 101. The output $V_{OL}$ of the buffer 101 is the output Q1 of the shift register 100, and is connected to the gate terminal of the thyristor T1. The above mentioned configuration applies to the outputs Q2 to Q8 of the shift register 100. The shift clock terminal SCK of the shift register 100 is connected to the clock terminals of the flip-flops 31-38, and the data terminal DATA of the printhead 91 is connected to the anodes of the thyristors T1-T8. The cathodes of the thyristors T1-T8 are grounded.

Figure 3:
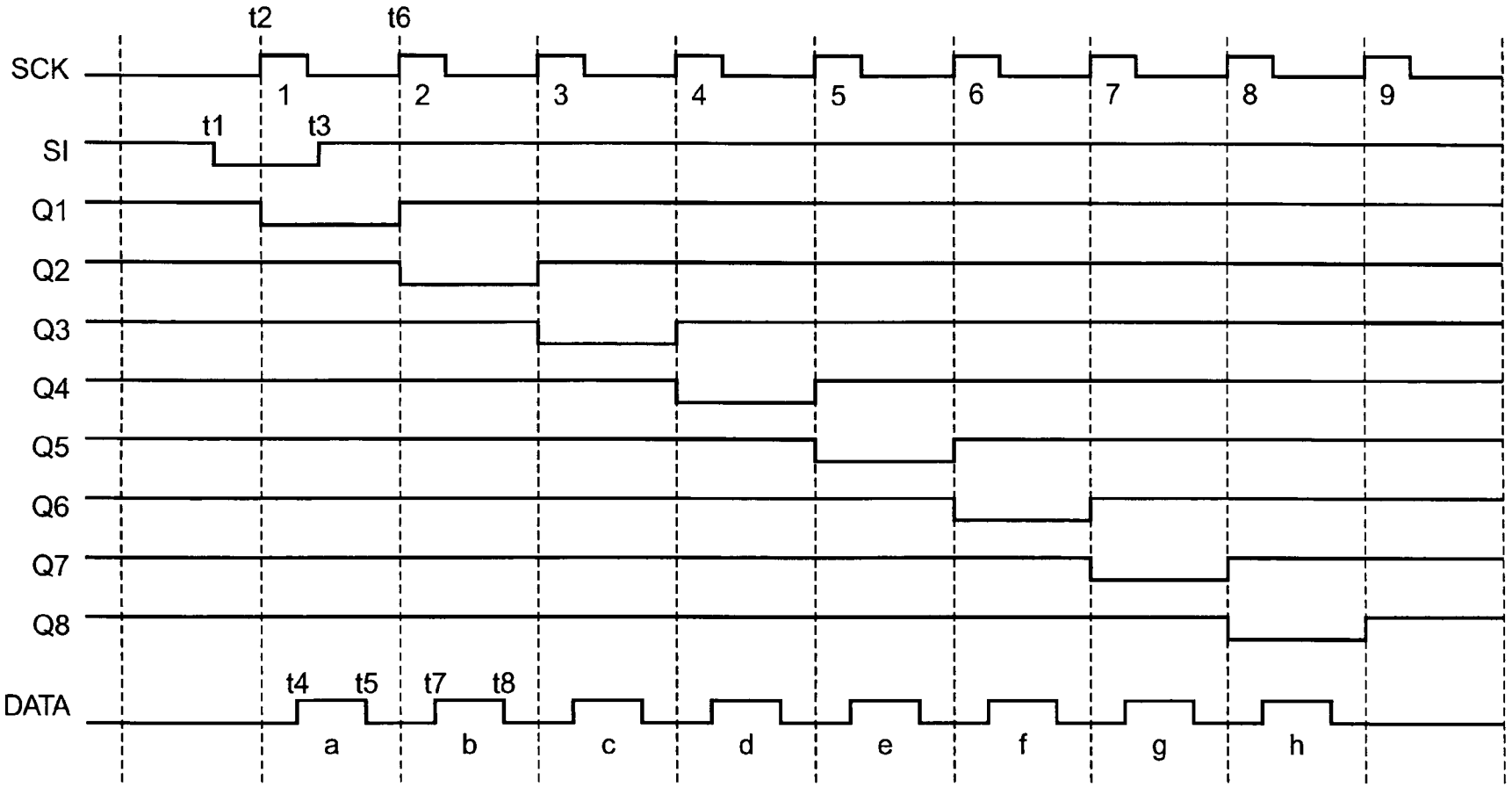
FIG. 3 is a timing chart illustrating the operation of the printhead.

FIG. 3 is a timing chart illustrating the operation of the printhead 91. For scanning one line of dots of an image, the thyristors T1-T8 shown in FIG. 2 turn on in this order. The shift register 100 is preset during the initial operation performed shortly after the printer is turned on, though not shown in FIG. 3. In the initial operation, the shift data terminal SI of FIG. 2 is set to high and the printhead 91 receives as many clock pulses as there are stages in the shift register 100. The initial operation sets all of the outputs Q1-Q8 of the shift register 100 to high.

Referring to FIG. 3, the shift data terminal SI is set to low at time t1 prior to the scanning of one line. The first pulse of the shift clock is then input to the shift clock terminal SCK at time t2. Upon receiving the shift clock, the data signal at the shift data terminal SI is captured into the first flip-flop 31 of the shift register 100, so that the Q output of the first flip-flop 31 goes low. After the shift clock at the shift clock terminal SCK has gone high, the shift data terminal SI is set to high again at time t3.

The low level of the output Q1 causes the gate potential of the thyristor T1 to go low. The data terminal DATA is set to high at time t4, causing a difference in potential between the anode and cathode of the thyristor T1. The potential difference causes a trigger current to flow, thereby turning on the thyristor T1 to emit light. Light mission of the thyristor T1 is mainly caused by the current flowing from anode to cathode. Thus, the voltage across the anode and cathode must be set to zero in order to turn off the thyristor. For this purpose, the potential of the data terminal DATA is set to low at time t5.

As described previously, the light output of the thyristor T1 mainly depends on the amount of current flowing through the anode-cathode junction. Thus, if a driver circuit 151 for driving the data terminal DATA shown in FIG. 2 is a constant current source, the anode to cathode current may be maintained constant irrespective of whether the anode-to-cathode voltage of the thyristor during light emission varies from thyristor to thyristor.

In FIG. 3, the data terminal DATA is set to high at time t4 to turn on the thyristor T1, and is set to low at time t5 to turn off. If the thyristor T1 is not to remain turned on, the data terminal DATA may remain low from time t4 to time t5. In this manner, the amount of current supplied from the data terminal DATA is changed to set the thyristor T1 either to a light emission state or to a non-light emission state.

The shift clock at the shift clock terminal SCK rises at time t6. At this moment, the shift data terminal SI is high so that the output Q1 goes high, while the output Q2 goes low. Then, the data terminal DATA is set to high at time t7. This causes a difference in potential between the anode and the cathode, causing a trigger current to turn on the thyristor T2 to emit light. The thyristor T2 continues to emit light as long as current flows from anode to cathode. Therefore, the voltage across the anode and cathode must be set to zero in order to turn off the thyristor T2. For this reason, the data terminal DATA is set to low at time t8.

As described above, on the rising edges of the clock signals 1, 2, 3, 4, 5, 6, 7, and 8 at the shift clock terminal SCK, the outputs Q1, Q2, Q3, Q4, Q5, Q6, Q7, and Q8 go low, only one of the outputs going low at any moment. Thus, when the signal at the data terminal DATA is high, only one thyristor goes on if a corresponding output Q goes low.

The only requirement for the thyristors T1-T8 to turn on is that the potential difference across the anode and the gate is large enough to forward bias the anode-gate junction for supplying the anode current. Also, the only requirement for the thyristors T1-T8 to remain off is that the potential difference across the anode and gate is smaller than the forward voltage across the anode and cathode. This may be achieved either by setting the potential difference to zero or applying a voltage across the anode-cathode junction in a reverse direction.

Figure 4A:
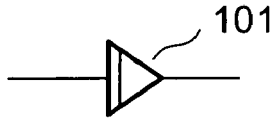
FIG. 4A illustrates the configuration of a buffer shown in FIG. 2.
Figure 4B:
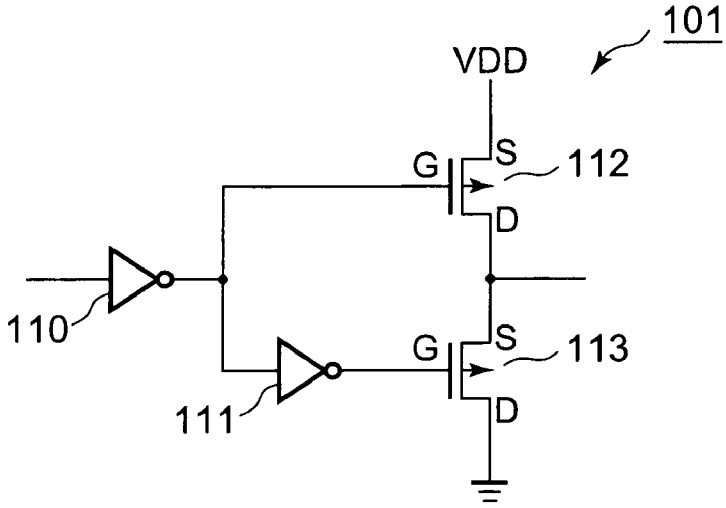
FIG. 4B illustrates the details of the buffer.

FIG. 4A illustrates the configuration of the buffers 101-108 shown in FIG. 2. FIG. 4B illustrates the details of the buffer 101. The output of an inverter 110 is connected to the gate of a PMOS transistor 112 and the input of an inverter 111. The output of the inverter 111 is connected to the gate of the PMOS transistor 113. The source of the PMOS transistor 112 is connected to the power supply voltage VDD. The drain of the PMOS transistor 112 is connected to the output $V_{OL}$ of the buffer 101 and the source of the PMOS transistor 113. The drain terminal of the PMOS transistor 113 is connected to the ground.

Figure 4C:
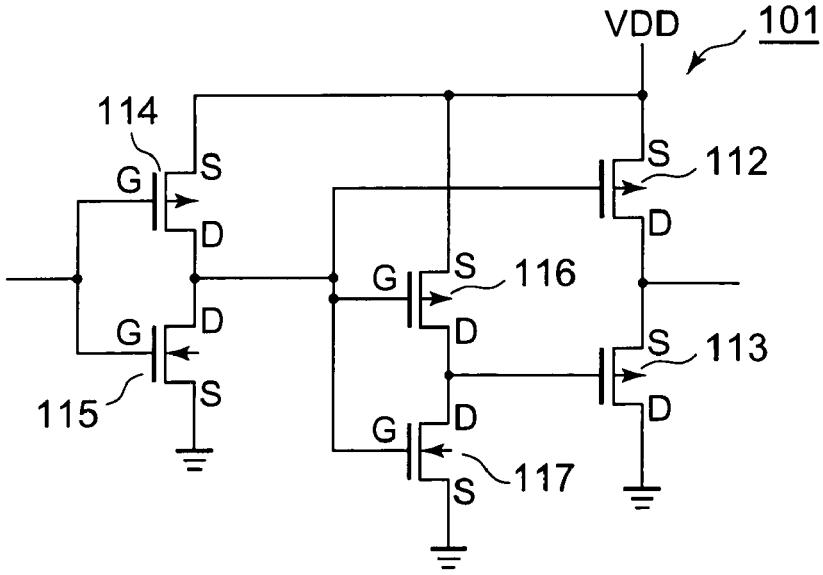
FIG. 4C illustrates the buffer together with the details of an inverter.

FIG. 4C illustrates the buffer 101 together with the details of the inverters 110 and 111. A PMOS transistor 114 operates with an NMOS transistor 115 to form the inverter 110. A PMOS transistor 116 cooperates with an NMOS transistor 117 to form the inverter 111. The gates of the PMOS transistor 114 and NMOS transistor 115 are connected together, and function as an input terminal of the inverter 110.

The source of the PMOS transistor 114 is connected to the power supply voltage VDD, and the source of the NMOS transistor 115 is connected to the ground. The drains of the PMOS transistor 114 and NMOS transistor 115 are connected together, and function as an output terminal of the inverter 110. The gates of the PMOS transistor 116 and NMOS transistor 117 are connected together, and function as an input terminal of the inverter 111.

The source of the PMOS transistor 116 is connected to the power supply voltage VDD, and the source of the NMOS transistor 117 is connected to the ground. The drains of the PMOS transistor 116 and NMOS transistor 117 are connected together, and function as an output terminal of the inverter 111. As is clear from FIG. 4C, six transistors are required to form a driver buffer for driving the thyristor of the first embodiment.

Figure 5A:
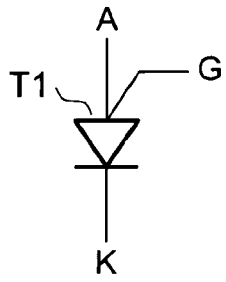
FIG. 5A illustrates a symbol of a thyristor including an anode terminal, a cathode terminal, and a gate terminal.
Figure 5B:
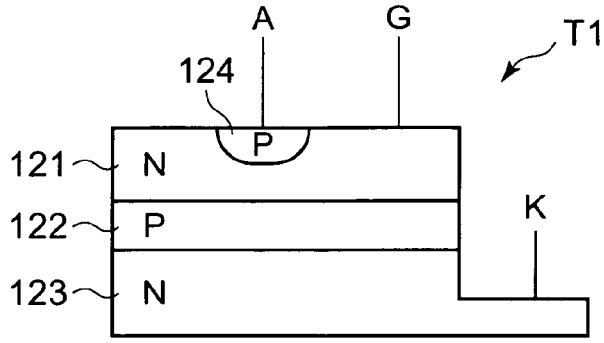
FIG. 5B is a conceptual diagram of the thyristor.

FIGS. 5A-5D illustrates the configuration of the thyristor shown in FIG. 2. FIG. 5A illustrates a symbol of a thyristor T1 including an anode terminal A, a cathode terminal K, and a gate terminal G. FIG. 5B is a conceptual diagram of the thyristor T1. The thyristor shown in FIG. 5B is formed of a predetermined crystal structure epitaxially grown on a GaAs wafer by a known metal organic chemical vapor deposition (MO-CVD) method.

After epitaxially growing buffer layers and sacrificial layers (not shown), a three-layer structure is formed on an AlGaAs substrate, including an N-type layer 123, a P-type layer 122, and an N-type layer formed in this order. The N-type layer 123 is doped with an N-type impurity. The P-type layer 122 is doped with a P-type impurity. The N-type layer 121 is doped with an N-type impurity. Then, a P-type impurity region 124 is selectively formed in a part of the N-type layer 121 by photolithography. Grooves are formed by dry etching to isolate individual elements. During the etching process, a part of the N-type layer 123 at the bottom is exposed. Then, metallization is performed to form a cathode electrode K on the exposed portion of the N-type layer 123. The anode electrode A is formed on the P-type region 124, and a gate electrode G is formed on the N-type region 121.

Figure 5C:
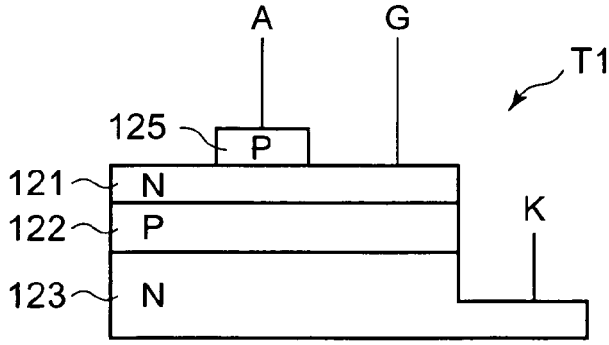
FIG. 5C illustrates another embodiment of a thyristor.

FIG. 5C illustrates another embodiment of a thyristor. Referring to FIG. 5C, a predetermined crystal structure is epitaxially grown on a GaAs substrate by MO-CVD. After epitaxially growing buffer layers and sacrificial layers (not shown), a four-layer structure is formed on an AlGaAs substrate, including an N-type layer 123, a P-type layer 122, an N-type layer 121, and a P-type layer 125 formed in this order.

Grooves are formed by known dry etching to isolate individual elements. During the etching process, a part of the N-type layer 123 at the bottom is exposed. Then, metallization is performed to form a cathode electrode K on the exposed portion of the N-type layer 123. An anode electrode A is formed on the P-type region 125, and a gate electrode G is formed on the N-type region 121.

Figure 5D:
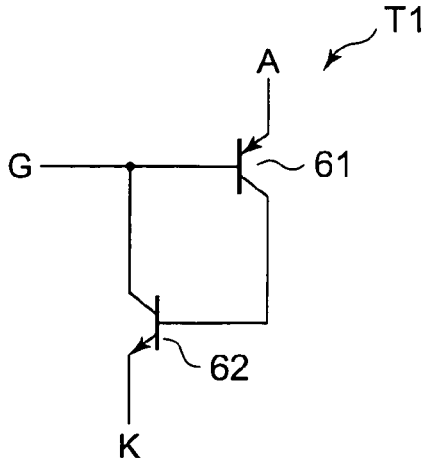
FIG. 5D is a schematic diagram equivalent to the thyristor shown in FIGS. 5B and 5C.

FIG. 5D is a schematic diagram equivalent to the thyristor shown in FIGS. 5B and 5C. Referring to FIG. 5D, the thyristor includes a PNP transistor 61 and an NPN transistor 62. The emitter of the PNP transistor 61 functions as the anode terminal A of the thyristor. The base of the PNP transistor 61 functions as the gate terminal G of the thyristor. The base of the PNP transistor 61 is connected to the collector of the NPN transistor 62. The collector of the PNP transistor 61 is connected to the base of the NPN transistor 62. The emitter of the NPN transistor 62 functions as the cathode K of the thyristor.

The aforementioned thyristors are bonded to an IC wafer on which the shift register 100 is integrated, bonding being performed by epitaxial film bonding disclosed in Laid Open Japanese Patent No. 2007-81081. Electrical connection between the thyristors and the IC wafer is made by photolithography. Then, the IC wafer having the thyristors bonded thereon is diced into a plurality of chips, thereby providing composite chips configured with light emitting elements and driver elements.

Figure 6:
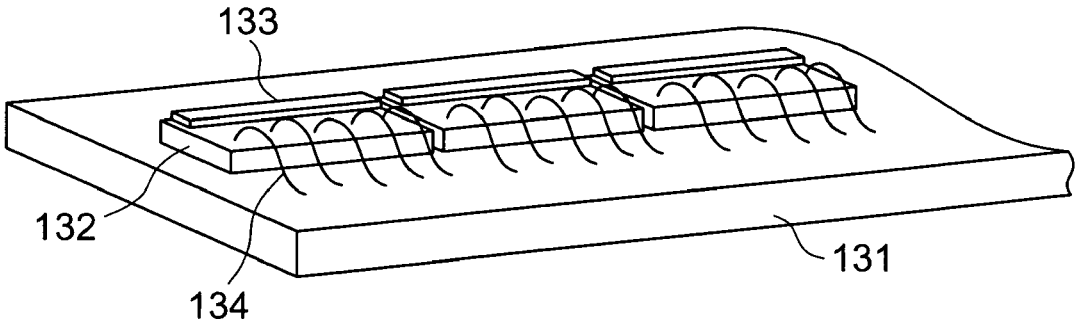
FIG. 6 is a perspective view of a circuit board of an optical printhead.

FIG. 6 is a perspective view of a circuit board 131 of an optical printhead. The circuit board includes the light emitting elements and driver elements mounted on the print circuit board 131. Referring to FIG. 6, each IC chip 132 includes the shift register 100 integrated thereon. Thyristors 133 are aligned on the IC chips 132. Bonding wires 134 are used to electrically connect the respective terminals of the shift register 100 on the IC chip 132 to the pads formed on the print circuit board 131.

Figure 7:
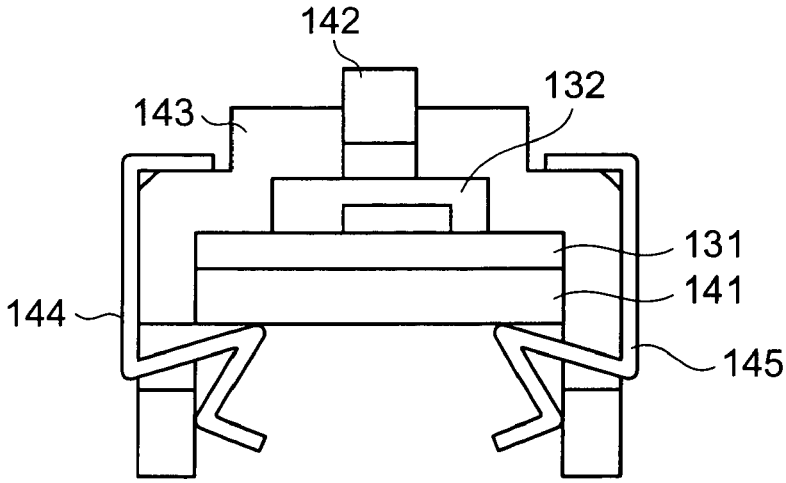
FIG. 7 is a cross-sectional view illustrating the configuration of the thyristor.

FIG. 7 is a cross-sectional view illustrating the configuration of the thyristor 91. Referring to FIG. 7, the optical printhead 91 includes a base 141, a print circuit board 131, a rod lens array 142, a holder 143, and clamps 144 and 145. The print circuit board 131 includes IC chips 132 mounted thereon, and is fixed to the base 141. The rod lens array 142 includes a plurality of cylindrical optical elements. The holder 143 holds the rod lens array 142. The clamps 144 and 145 firmly hold the print circuit board 131, base 141, and holder 143 together.

Figure 8A:
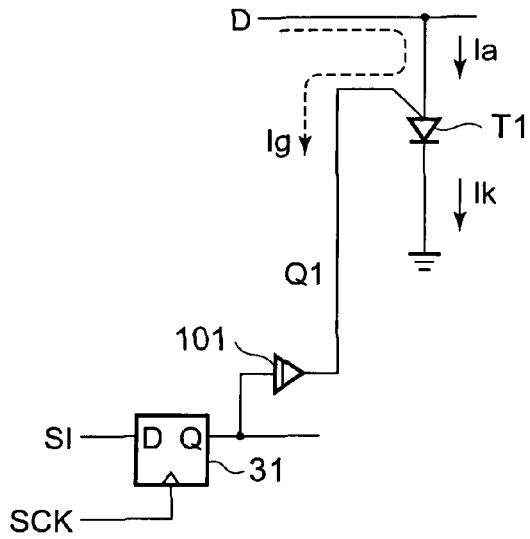
FIG. 8A illustrates the thyristor, flip-flop, and buffer shown in FIG. 2.

The operation of the first embodiment will be described in detail. FIG. 8A illustrates the thyristor T1, flip-flop 31, and buffer 101 shown in FIG. 2. The anode current Ia and cathode current Ik are indicated in solid line, and the gate current Ig is indicated in dotted line.

{Operation}

Figure 8B:
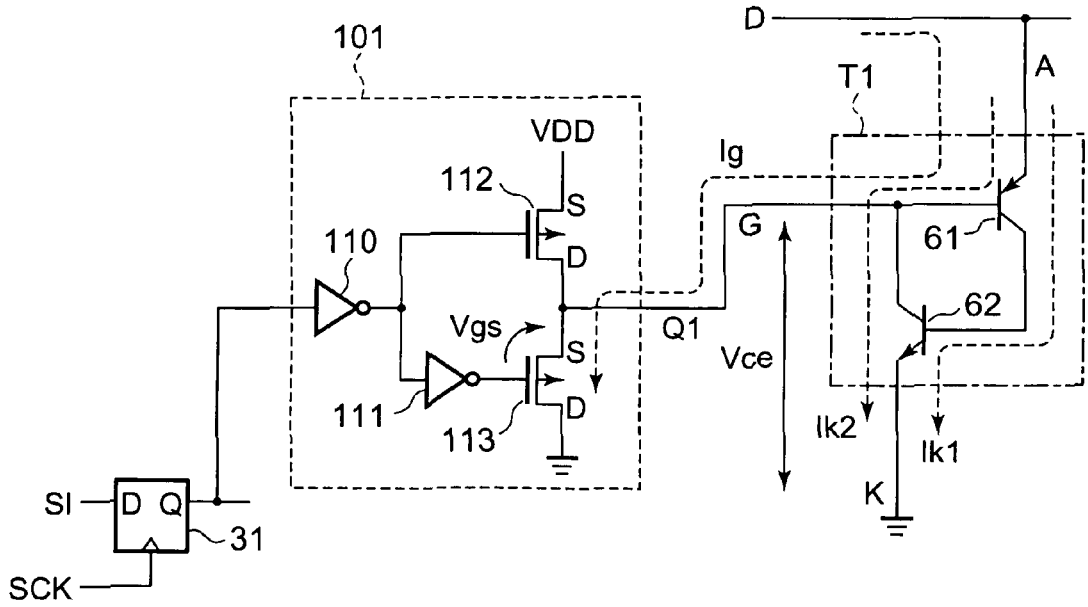
FIG. 8B illustrates the configuration of the buffer shown in FIG. 8A.

FIG. 8B illustrates the configuration of the buffer 101 shown in FIG. 8A. FIG. 8B illustrates the details of the buffer 101 enclosed by dotted lines. The thyristor T1 is enclosed by dot-dashed lines. Thyristors are devices of PNPN configuration in which a P-type semiconductor layer and an N-type semiconductor layer are stacked alternately one over the other to form a PNPN structure as a whole. As shown in FIG. 8B, the equivalent circuit of a thyristor may be expressed by the combination of a PNP 61 transistor 61 and an NPN transistor 62. The emitter of the PNP transistor 61 functions as the anode of the thyristor T1, and the base of the PNP transistor 61 functions as the gate of the thyristor T1. The base of the PNP transistor 61 is also connected to the collector of the NPN transistor 62.

The collector of the PNP transistor 61 is connected to the base of the NPN transistor 62. The emitter of the NPN transistor 62 functions as the cathode of the thyristor T1, and is grounded. As described with reference to FIG. 3, when the thyristor T1 is to emit light, the Q output of the flip-flop 31 is set to low. At this moment, the output of the inverter 110 goes high, and the output of the inverter 11 goes low. Also, the PMOS transistor 112 turns off and the PMOS transistor 113 turns on, so that the potential of the gate G decreases from substantially VDD to a potential substantially equal to the threshold Vt of PMOS transistors, which is typically 1 V.

When the thyristor turns on, the thyristor is driven by a constant current supplied from the data terminal DATA, so that the voltage across the anode and cathode increases. Therefore, the gate current Ig flows in a path shown in the dotted line, causing the base current of the PNP transistor 61 to flow to turn on the PNP transistor 61. Thus, the collector current of the PNP transistor 61 flows as the cathode current Ik1. The cathode current Ik1 flows into the base of the NPN transistor 62, so that the NPN transistor 62 turns on to cause the collector current (i.e., cathode current Ik2) to flow through the base of the NPN transistor 61. The collector current or cathode current Ik2 maintains the NPN transistor 61 in the ON state.

When current flows through the thyristor (anode-cathode junction), the thyristor T1 emits light in accordance with the amount of the current. When the thyristor emits light, the thyristor is in the ON state and the collector-emitter voltage of the transistor 62 is Vce(sat). The collector-emitter voltage of the transistor 62 is determined by the physical shapes of the structural elements of the transistor 62 and the collector and base currents flowing through the transistor 62, and is referred to as collector-emitter saturation voltage Vce(sat). The Vce (sat) is typically in the range of 0.2-0.8 V.

As is clear from the timing chart shown in FIG. 3, the gate potential is low so that a part of the anode current supplied via the data terminal DATA flows as the gate current Ig through the buffer 101 to the ground. Assume that the output $V_{OL}$ of the buffer 101 is virtually disconnected from the gate of the thyristor T1. When the PMOS transistor 113 is in the ON state, the output voltage of the buffer 101 is approximately 1 V, which is substantially equal to the threshold voltage Vt of PMOS transistors as previously described.

The typical value of Vce(sat) of NPN transistors is in the range of 0.2-0.8 V. Therefore, the drive current supplied from the anode terminal of the thyristor T1 in the ON state flows as Ik2 and Ik1 that flows through the collector of the NPN transistor 62 and the collector of the PNP transistor 61. Thus, no current Ig flows from the gate of the thyristor to the ground through the buffer 101.

Figure 14A:
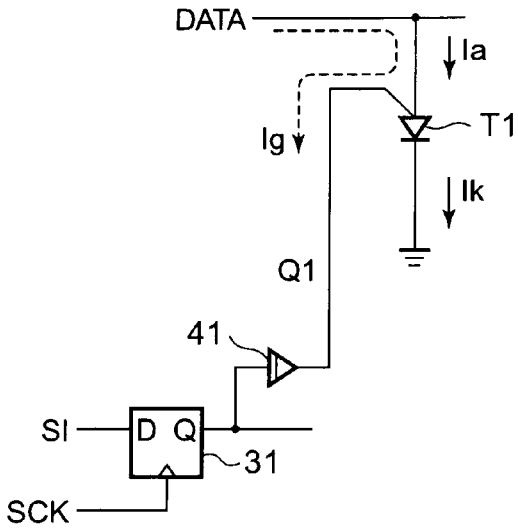
FIGS. 14A-14B illustrate one of a plurality of thyristors shown in FIG. 13, FIG. 14A illustrating the flip-flop, the buffer, and the thyristor and, FIG. 14B illustrating the detailed equivalent circuit of the circuit shown in FIG. 14A.
Figure 14B:
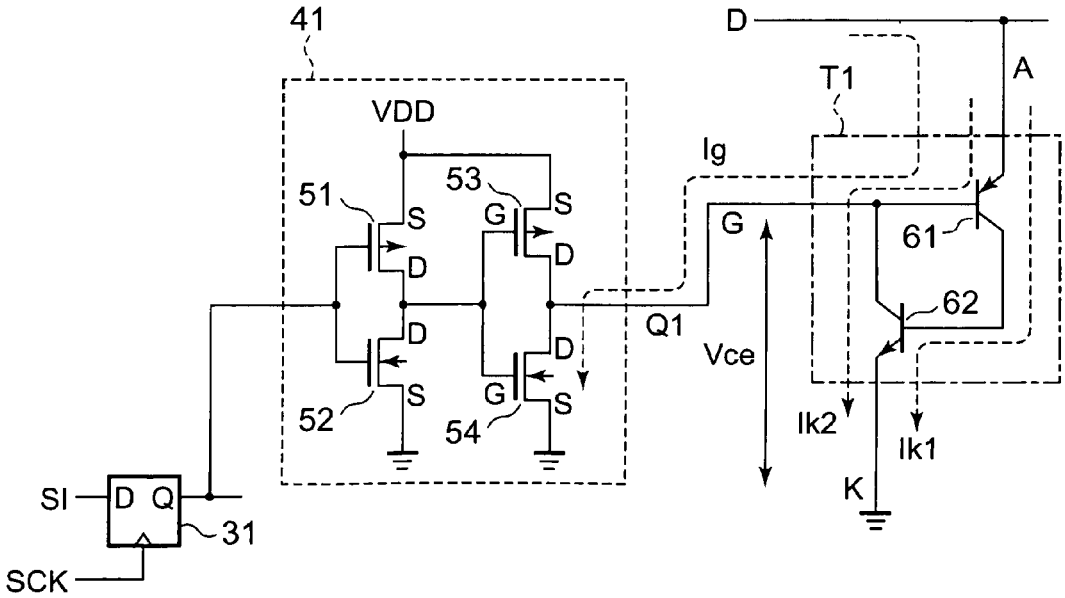

In the conventional configuration (FIG. 14), when the thyristor is in the ON state, a part of the anode current flows as a non-effective, detrimental leakage current into the buffer 41. This gate current causes a decrease in the light output emitted from the thyristor. In FIG. 8, the gate potential of the thyristor T1 in the ON state will not excessively decrease, thereby decreasing the non-effective, detrimental leakage current flowing out of the gate. This increases the light output of the thyristor.

The gate current of a thyristor varies with the power supply voltage and ambient temperature. The first embodiment solves the problem in which apart of the anode current flows as the gate current of the thyristor into the buffer to decrease the light output from the thyristor. This solves uneven density in the print out of the image forming apparatus, which would otherwise result from the changes in gate current and ambient temperature.

Modification to the First Embodiment

Figure 9:
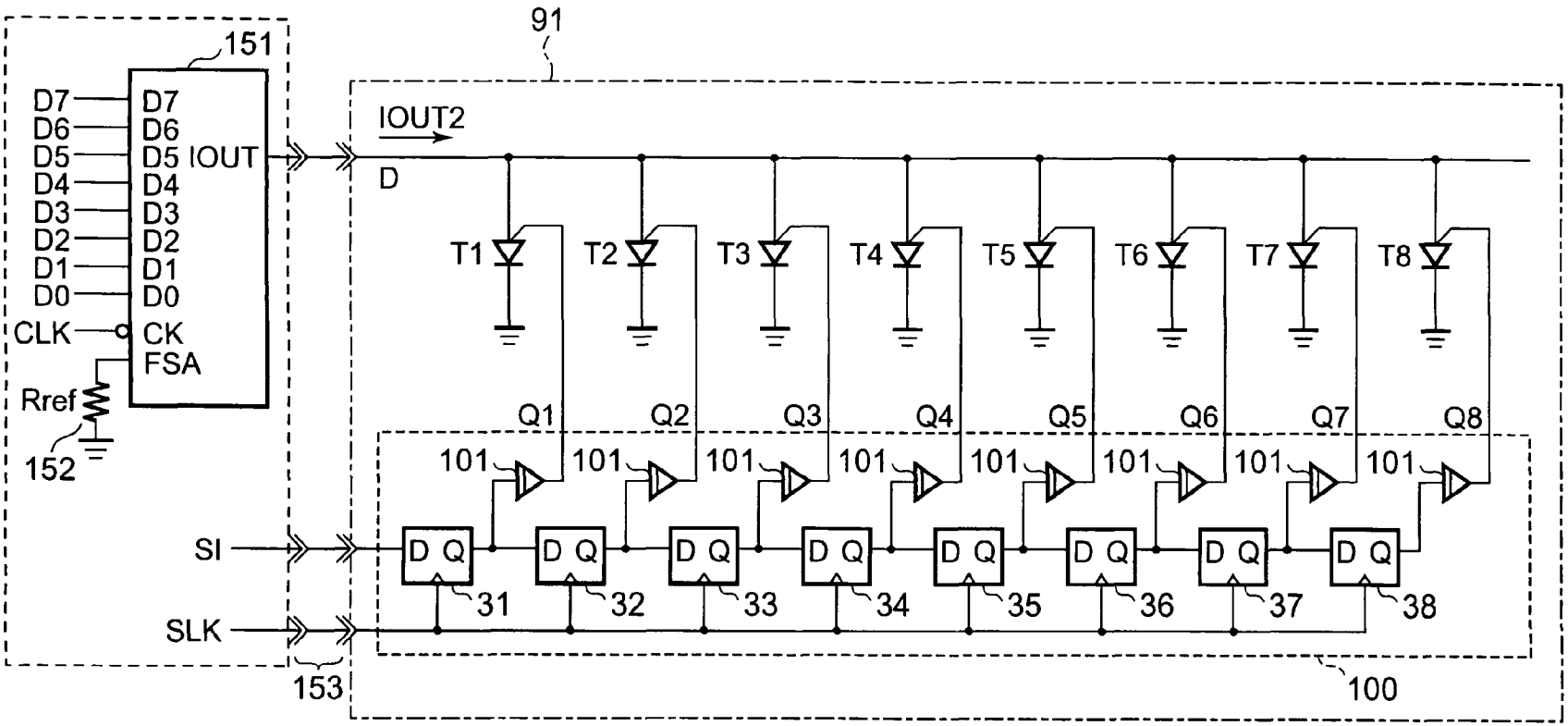
FIG. 9 illustrates a modification to the first embodiment.

FIG. 9 illustrates a modification to the first embodiment. A cable 153 connects the print controller 1 and the optical printhead 91 through a connector depicted at "->>-". Reference numerals 100 and T1-T8 denote a shift register 100 and the thyristors, respectively. Reference numeral 151 denotes a D/A converter residing in the print controller 1. Reference numeral 152 denotes a reference resistance Rref.

The D/A converter 151 includes data input terminals D7-D0, a clock terminal CK, a reference current setting terminal FSA, and an output terminal IOUT through which the drive current is supplied to a thyristor. Digital data is input to the data input terminals D7-D0 on the pulses of the clock signal CLK (not shown). A current IOUT2 specified by the data at the data input terminals D7-D0 is outputted from the output terminal IOUT.

The D/A converter 151 includes a reference voltage source (not shown) that provides an output voltage Vref to an input terminal (not shown) of the D/A converter 151. A reference current Iref is given by Vref/Rref, and is a maximum when the data described by D7-D0 is a maximum. This current Iref varies in 256 steps in accordance with the values described by the data D7-D0, so that the current IOUT2 changes in 256 steps.

Figure 10:
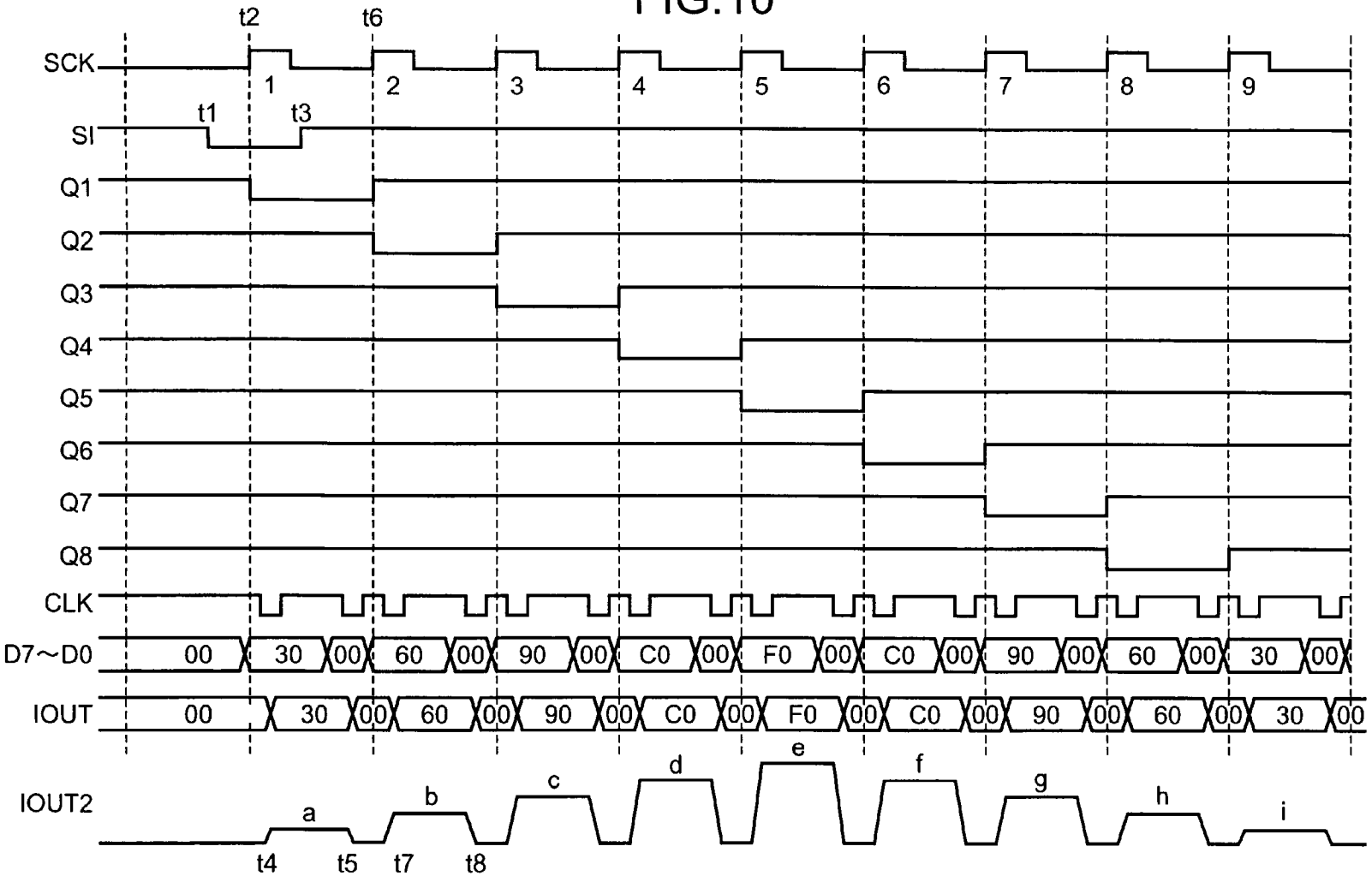
FIG. 10 is a timing chart illustrating the operation of a circuit shown in FIG. 9.

FIG. 10 is a timing chart illustrating the operation of the circuit shown in FIG. 9. Referring to FIG. 10, the values of data D7-D0 are expressed in the hexadecimal system, and therefore the drive current IOUT2 is proportional to the value expressed by the data D7-D0. The data D7-D0 is an 8-bit data that can express a maximum of 255 in the decimal system. If the drive current is controlled in increments of, for example, 0.1 mA, then the maximum drive current is 0.1×255=25.5 mA. FIG. 10 illustrates the operation for scanning one line to of an image, in which the thyristors T1-T8 shown in FIG. 9 are turned on in sequence. The shift register 100 is initially preset upon power-up of the printer. That is, the shift clock terminal SCK receives as many shift clock pulses as there are stages of the shift register 100. Thus, the outputs Q1-Q8 of the shift register 100 are all high.

Referring to FIG. 10, the shift data terminal SI is set to low at time t1 immediately before scanning one line of the image. Then, the first pulse is inputted to the shift clock terminal SCK at time t2. Upon the shift clock, the flip-flop 31 which is the first stage of the shift register 100 captures the shift data at the shift data terminal SI, so that the output Q1 goes to low.

After the first pulse at the shift clock terminal SCK, the shift data terminal SI returns to high again at time t3.

When the output Q1 goes high, the gate potential of the thyristor T1 decreases. Data "30" in the hexadecimal system enters the D/A converter 151 on the rising edge of the first pulse of the clock signal CLK. Then, the cock signal CLK at the D/A converter 151 goes low at time t4, so that the D/A converter 151 captures the data "30", and generates a drive current IOUT2 in accordance with the data "30." The drive current IOUT2 causes a potential difference across the anode and gate of the thyristor T1, so that the resulting gate current causes the thyristor T1 to turn on to emit light.

The light output of the thyristor T1-T8 is primarily determined by the amount of current flowing from anode to cathode. Because the D/A converter 151 generates a drive current described by the data D7-D0, the drive current may be maintained at a substantially constant value even if the voltage across the anode-cathode junctions of the thyristors in the ON state may vary from thyristor to thyristor. This maintains a substantially constant light output irrespective of fluctuation in the power supply voltage.

In order to turn off the thyristor, the voltage across the anode-cathode junction must be set to zero. For this purpose, the data D7-D0 of "00" is input to the D/A converter 151 so that the D/A converter captures the data D7-D0 of "00" on the falling edge of the clock signal CLK at time t5, so that the drive current IOUT2 outputted from the IOUT terminal becomes zero, causing the thyristor to go off. If the thyristor need not emit light for a period of time from t4 to t5, then the data D7-D0 of "00" may be maintained for the period of time from t4 to t5.

As described above, selecting the value of the data D7-D0 allows not only switching of the thyristor on and off but also setting of the drive current in 256 steps. At time t6, the shift clock at the shift clock terminal SCK rises. At this moment, because the shift data terminal SI has gone high, the output Q1 goes high while the output Q2 goes low.

At this moment, data D7-D0 of "60" in the hexadecimal system is inputted to the D/A converter 151. Then, the clock signal CLK falls at time t7, so that the D/A converter 151 outputs a drive current from the IOUT terminal. A potential difference appears across the anode-cathode junction of the thyristor T2, causing a trigger current to turn on the thyristor T2 to emit light.

Light emission of the thyristor T2 is primarily due to the fact that current flows through the anode-cathode junction. In order to stop light emission of the thyristor, the current through the anode-cathode junction must be shut off, or the voltage across the anode-cathode junction must be set to zero. For this purpose, the data D7-D0 of "00" is inputted to the D/A converter 151. Then, the D/A converter 151 captures the data D7-D0 on the falling edge of the clock signal CLK at time t8. As a result, the drive current from the IOUT terminal becomes zero, turning off the thyristor T2.

As described above, on the rising edges of the shift clock pulses 1, 2, 3, 4, 5, 6, 7, and 8, the outputs Q1, Q2, Q3, Q4, Q5, Q6, Q7, and Q8 go low, only one of the outputs going low at any moment. Thus, when the data D7-D0 is not zero, a thyristor turns on if a corresponding output Q goes low. Of course, when the data D7-D0 is zero, none of the thyristors T1-T8 turns on.

Second Embodiment

Figure 11A:
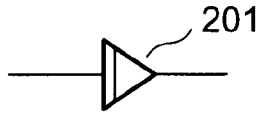
FIG. 11A illustrates a circuit symbol of the buffer.
Figure 11B:
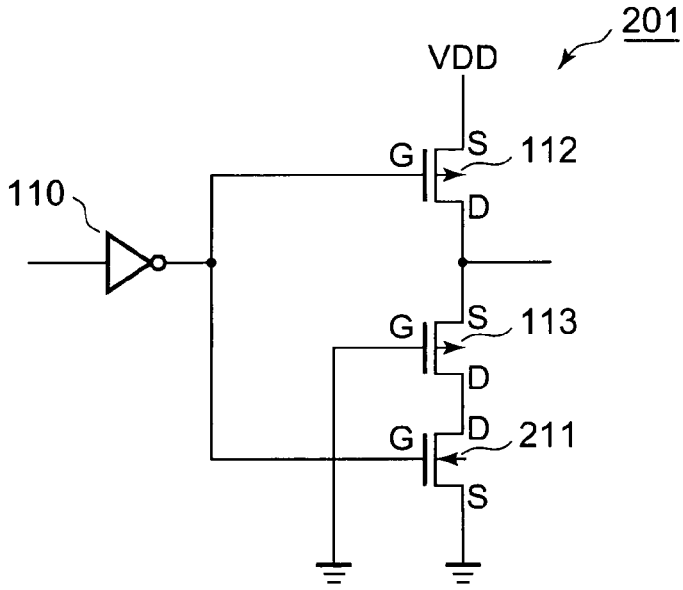
FIG. 11B illustrates a circuit equivalent to the buffer shown in FIG. 11A.

A second embodiment differs from the first embodiment in the configuration of buffers for driving thyristors. FIGS. 11A and 11B illustrate the configuration of a buffer 201 of the second embodiment. FIG. 11A illustrates a circuit symbol of the buffer 201. FIG. 11B illustrates a circuit equivalent to the buffer 201 shown in FIG. 11A.

Referring to FIG. 11B, the input terminal of an inverter 110 corresponds to an input terminal of the buffer 201 shown in FIG. 11A. The output of the inverted 110 is connected to the gates of a PMOS transistor 112 and an NMOS transistor 211. The source of the PMOS transistor 112 is connected to a power supply voltage VDD and the drain of the PMOS transistor 112 is the output terminal of the buffer 201. The output $V_{OL}$ of the buffer 201 is connected to the source of the PMOS transistor 113 and the drain terminal of the PMOS transistor 113 is connected to the drain terminal of the NMOS transistor 211, and the source terminal of the NMOS transistor 211 is connected to the ground. The gate of the PMOS transistor 113 is connected to the ground.

Figure 11C:
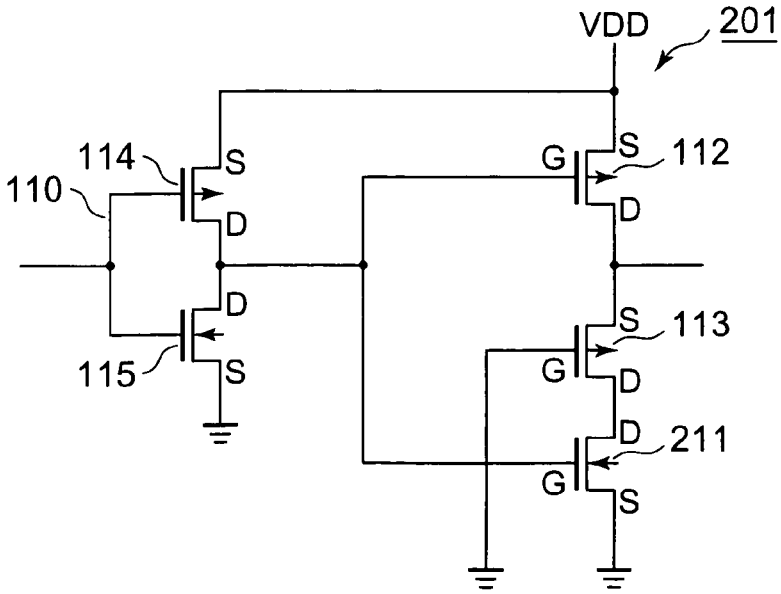
FIG. 11C illustrates the buffer with the detail of the inverter.

FIG. 11C illustrates the buffer 201 with the detail of the inverter 110. The inverter 110 includes a PMOS transistor 114 and an NMOS transistor 115. The gates of the PMOS transistor 114 and NMOS transistor 115 are connected together and serve as an input terminal of the inverter 110. The source of the PMOS transistor 114 is connected to the power supply voltage VDD. The drains of the PMOS transistor 114 and the NMOS transistor 115 are connected together, and serve as an output terminal of the inverter 110. The source of the NMOS transistor 115 is connected to the ground.

As is clear from FIG. 11C, five transistors are required for configuring the buffer for driving the thyristor. In other words, the second embodiment uses a smaller number of transistors than the first embodiment, thus requiring a smaller area on an IC chip and being cost saving.

Figure 12A:
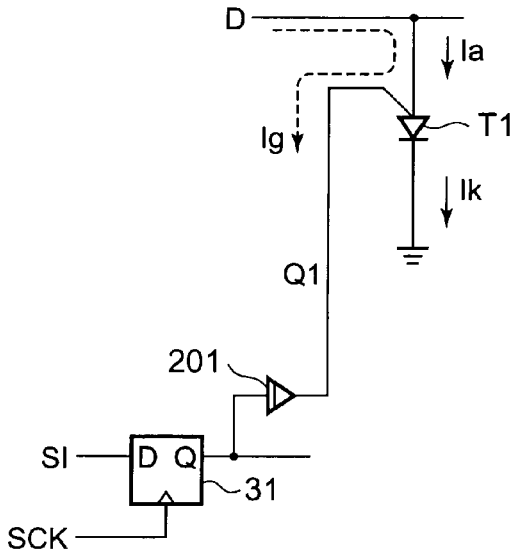
FIG. 12A illustrates a thyristor, a flip-flop, and the buffer.

The operation of the second embodiment will be described in detail. FIG. 12A illustrates a thyristor T1, a flip-flop 31, and the buffer 201. The anode current Ia and cathode current Ik flow in a path indicated in solid lines and the gate current Ig flows in a path indicated in dotted line.

Figure 12B:
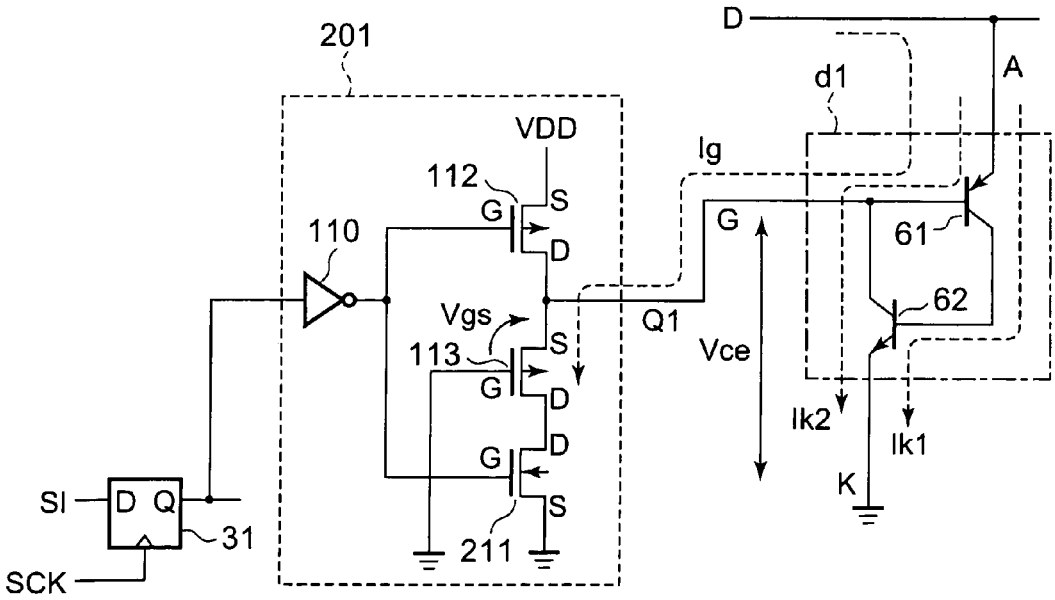
FIG. 12B illustrates the details of the buffer enclosed by dotted lines.
Figure 13:
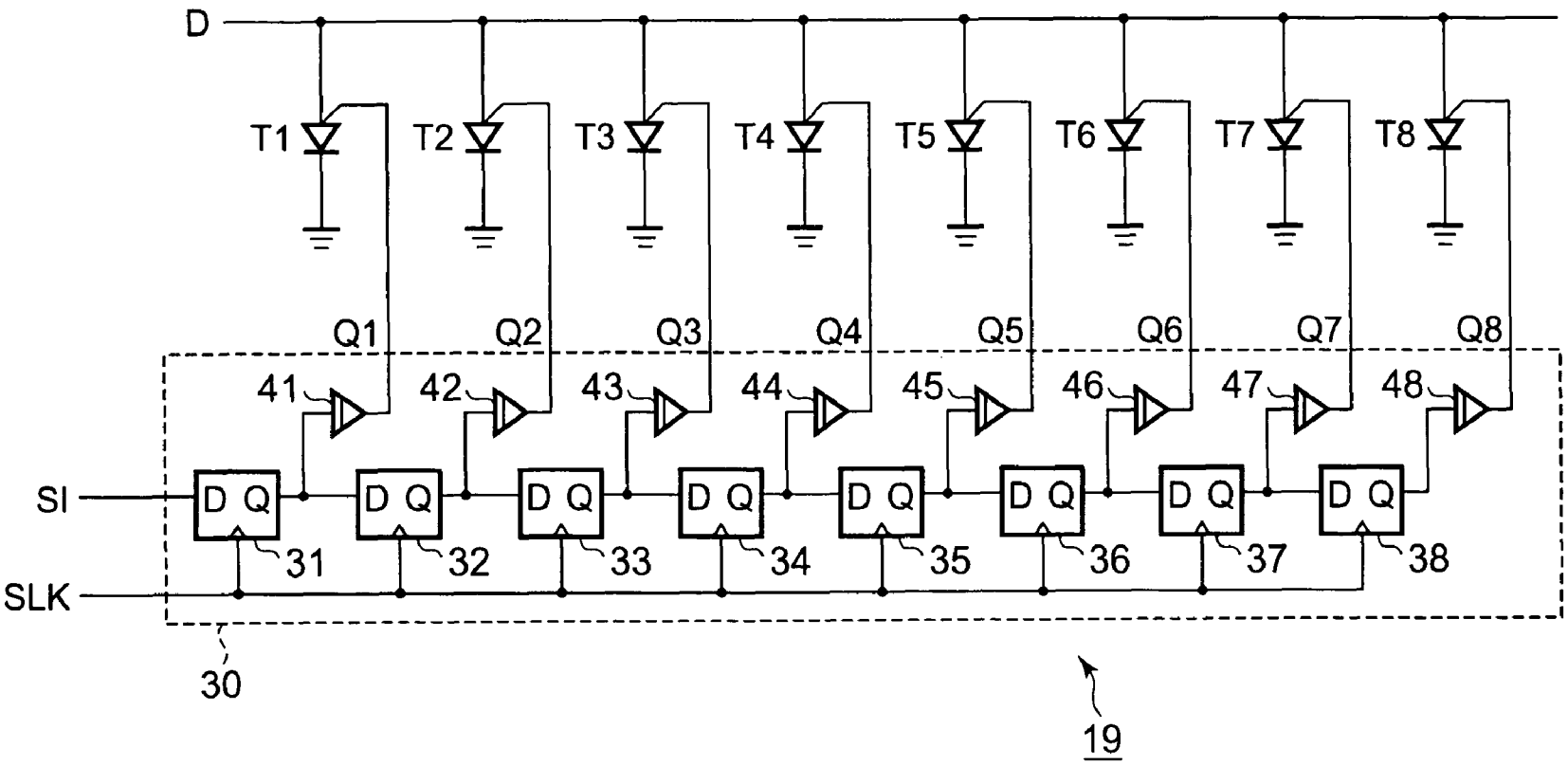
FIG. 13 is the circuit diagram of a conventional optical printhead.

FIG. 12B illustrates the details of the buffer 201 enclosed by dotted lines. The thyristor T1 is enclosed by dot-dashed lines. Thyristors are devices of PNPN configuration in which a P-type semiconductor layer and an N-type semiconductor layer are stacked alternately one over the other to form a PNPN structure. As shown in FIG. 12B, the equivalent circuit of a thyristor may be expressed by the combination of a PNP transistor 61 and an NPN transistor 62. The emitter of the PNP transistor 61 corresponds to the anode of the thyristor T1, and the base of the PNP transistor 61 corresponds to the gate of the thyristor T1. The base of the PNP transistor 61 is connected to the collector of the NPN transistor 62. The collector of the PNP transistor 61 is connected to the base of the NPN transistor 62. The emitter of the NPN transistor 62 corresponds to the cathode of the thyristor T1, and is grounded.

Assume that the output of the flip-flop 31 is high. Thus, the input of the buffer 201 is high and the output of an inverter 110 is low, so that a PMOS transistor 112 turns on and an NMOS transistor 211 turns off. Thus, the voltage of output $V_{OL}$ of the buffer 201 is substantially equal to the power supply voltage VDD.

As described with reference to FIG. 3, when the Q output of the flip-flop 31 goes low, the thyristor T1 turns on. At this moment, the output of the inverter 110 goes high, so that the PMOS transistor 112 turns off and the NMOS transistor 211 turns on. As shown in FIG. 12B, the gate of the PMOS transistor 113 is grounded. If the voltage across the gate and source of the PMOS transistor 113 exceeds the threshold voltage Vt (typically 1 V) of the PMOS transistor 113, the PMOS transistor 113 conducts. Thus, if the value expressed by the data D7-D0 in the hexadecimal system is not zero, the gate current Ig flows in a path indicated by dotted line, causing the thyristor to turn on. As a result, the output $V_{OL}$ of the buffer 201 decreases from a potential substantially equal to the VDD to a potential substantially equal to the Vt.

The thyristor T1 will be described in more detail. When the thyristor turns on, a drive current having a constant value flows from the DATA terminal into the thyristor, causing the voltage across the anode-cathode junction to increase. The gate current flows as shown by the dotted line, and the base current flows through the PNP transistor 61 to turn on the PNP transistor 61. The collector current of the PNP transistor 61 serves as the current Ik1 which in turn is the base current of the NPN transistor 62. Thus, the NPN transistor 62 turns on to cause a collector current, which serves as Ik2. The current Ik2 flows through the PNP transistor 61, causing the PNP transistor 61 to remain in its ON state.

The thyristor T1 emits light in accordance with the amount of the current flowing from anode to cathode, and the collector-emitter voltage of the NPN transistor 62 is Vce(sat). The collector-emitter voltage is determined by the physical shape of the structural elements of the NPN transistor 62 and the collector and emitter currents flowing through the NPN transistor 62, and is called collector-emitter saturation voltage Vce(sat). The Vce(sat) is typically in the range of 0.2-0.8 V.

As described with reference to the timing chart shown in FIG. 3, the gate potential is low so that a part of the anode current supplied via the DATA terminal flows as the gate current Ig through the buffer 201 to the ground. Assume that the output $V_{OL}$ of the buffer 201 is virtually disconnected from the gate of the thyristor T1. When the PMOS transistor 113 is in the ON state, the output $V_{OL}$ of the buffer 201 is approximately 1 V, which is substantially equal to the threshold voltage Vt of PMOS transistors as previously described.

The typical value of Vce (sat) of the NPN transistor 62, which is a part of the thyristor T1, is in the range of 0.2-0.8 V. Therefore, the output $V_{OL}$ of the buffer 201 is higher than the Vce (sat) of the NPN transistor 62. Once the thyristor T1 has turned on, the drive current supplied through the anode branches into Ik1 and Ik2, the Ik1 flowing into the collector of the PNP transistor 61 and the Ik2 flowing into the collector of the NPN transistor 62. Thus, no current Ig flows from the gate of the thyristor T1 to the ground through the buffer 201.

In the conventional configuration (FIG. 14), when the thyristor is in the ON state, a part of the anode current flowing into the optical thyristor flows as the gate current into the buffer. This gate current causes a decrease in the light output of the thyristor. In the second embodiment, the gate potential of the optical thyristor in the ON state will not excessively decrease, thereby decreasing a non-effective, detrimental leakage current flowing out of the gate and thus improving the light emission efficiency of the thyristor.

In addition, despite the fact that the buffer 201 shown in FIG. 11C uses one less number of transistors than the buffer 101 shown in FIG. 4C, the buffer 201 functions on a par with the buffer 101. In other words, a smaller number of required transistors requires a smaller area on an IC chip and being cost saving.

The gate current varies with the power supply voltage and ambient temperature. The second embodiment prevents the gate potential of the thyristor from decreasing excessively, so that the non-effective, detrimental gate current is minimized to improve light emission efficiency. The second embodiment solves the problem in which a part of the anode current flowing into the thyristor flows out through the gate of the thyristor into the buffer to decrease the light output of the thyristor. Reducing the non-effective, detrimental gate current solves uneven density in the print out, which would otherwise result from the non-effective, detrimental gate current and ambient temperature.

The present invention has been described in terms of a driver circuit for driving thyristors incorporated in an optical printhead incorporated in an electrophotographic printer. The invention may also be applicable to an organic EL head that employs organic EL elements as a light source. Further, the invention may be applicable to a driver circuit for driving rows of display elements or heat generating elements for thermal printers.

The invention being thus described, it will be obvious that the same may be varied in many ways. Such variations are not to be regarded as a departure from the scope of the invention, and all such modifications as would be obvious to one skilled in the art intended to be included within the scope of the following claims.

What is claimed is:

1. A light emitting apparatus, comprising:

a light emitting element including a first terminal, a second terminal connected to ground, and a third terminal, said light emitting element turning on to emit light when a drive current flows from the first terminal to the second terminal through said light emitting element;

a driver circuit connected to the first terminal, said driver circuit supplying the drive current to said light emitting element when said light emitting element turns on; and a control circuit connected to the third terminal, said control circuit causing a control current to flow from the first terminal to the third terminal to turn on said light emitting element;

wherein said control circuit applies a control voltage to the third terminal, the control voltage being higher than a voltage across the third terminal and the second terminal when said light emitting element remains turned on;

wherein said control circuit includes a first switch element including a fourth terminal and fifth terminal and a second switch element including a sixth terminal and a seventh terminal, the first and second switch elements being of a common semiconductor conductivity type; and wherein the fourth terminal is connected to a power supply, the seventh terminal is connected to ground, and the fifth terminal and the sixth terminal are connected to the third terminal.

2. A light emitting apparatus, comprising:

a light emitting element including a first terminal, a second terminal connected to ground, and a third terminal, said light emitting element turning on to emit light when a drive current flows from the first terminal to the second terminal through said light emitting element;

a driver circuit connected to the first terminal, said driver circuit supplying the drive current to said light emitting element when said light emitting element turns on; and a control circuit connected to the third terminal, said control circuit causing a control current to flow from the first terminal to the third terminal to turn on said light emitting element;

wherein said control circuit applies a control voltage to the third terminal, the control voltage being higher than a voltage across the third terminal and the second terminal when said light emitting element remains turned on;

wherein said control circuit includes a first switch element and a second switch element that are of a first semiconductor conductivity type, and a third switch element of a second semiconductor conductivity type, the first switch element including fourth and fifth terminals, the second switch element including sixth and seventh terminals, and the third switch element including eighth and ninth terminals, wherein the fourth terminal is connected to a power supply, the ninth terminal is connected to ground, the fifth and sixth terminals are connected to the third terminal, and the seventh terminal is connected to the eighth terminal.

3. The light emitting apparatus according to claim 1, wherein the control voltage is higher than a threshold voltage of the first and second switch elements of the first semiconductor conductivity.

4. The light emitting apparatus according to claim 2, wherein the control voltage is higher than a threshold voltage of the first switch element and the second switch element of the first semiconductor conductivity type.

5. An optical printhead including a light emitting apparatus, wherein the light emitting apparatus comprises:

a light emitting element including a first terminal, a second terminal connected to the ground, and a third terminal, said light emitting element turning on to emit light when a drive current flows from the first terminal to the second terminal through said light emitting element;

a driver circuit connected to the first terminal, said driver circuit supplying a drive current to said light emitting element when said light emitting element turns on; and a control circuit connected to the third terminal and applying a control voltage to the third terminal, wherein the control voltage is higher than a voltage appearing at the second terminal when said light emitting element remains on wherein said control circuit includes a first switch element including a fourth terminal and fifth terminal and a second switch element including a sixth terminal and a seventh terminal, the first and second switch elements being of a common semiconductor conductivity type; and wherein the fourth terminal is connected to a power supply, the seventh terminal is connected to ground, and the fifth terminal and the sixth terminal are connected to the third terminal.

6. An image forming apparatus including an optical printhead that incorporates a light emitting apparatus, the light emitting apparatus comprising:

a light emitting element including a first terminal, a second terminal connected to ground, and a third terminal, said light emitting element emitting light when said light emitting element turns on;

a driver circuit connected to the first terminal, said driver circuit supplying a drive current to said light emitting element when said light emitting element turns on; and a control circuit connected to the third terminal and applying a control voltage to the third terminal, wherein the control voltage is higher than a voltage appearing at the second terminal when said light emitting element remains on;

wherein said control circuit includes a first switch element including a fourth terminal and fifth terminal and a second switch element including a sixth terminal and a seventh terminal, the first and second switch elements being of a common semiconductor conductivity type; and wherein the fourth terminal is connected to a power supply, the seventh terminal is connected to ground, and the fifth terminal and the sixth terminal are connected to the third terminal.

7. An optical printhead including a light emitting apparatus, the light emitting apparatus comprising:

a light emitting element including a first terminal, a second terminal connected to the ground, and a third terminal, said light emitting element turning on to emit light when a drive current flows from the first terminal to the second terminal through said light emitting element;

a driver circuit connected to the first terminal, said driver circuit supplying a drive current to said light emitting element when said light emitting element turns on; and a control circuit connected to the third terminal and applying a control voltage to the third terminal, wherein the control voltage is higher than a voltage appearing at the second terminal when said light emitting element remains on;

wherein said control circuit includes a first switch element and a second switch element that are of a first semiconductor conductivity type, and a third switch element of a second semiconductor conductivity type, the first switch element including fourth and fifth terminals, the second switch element including sixth and seventh terminals, and the third switch element including eighth and ninth terminals, and wherein the fourth terminal is connected to a power supply, the ninth terminal is connected to ground, the fifth and sixth terminals are connected to the third terminal, and the seventh terminal is connected to the eighth terminal.

8. An image forming apparatus including an optical printhead that incorporates a light emitting apparatus, the light emitting apparatus comprising:

a light emitting element including a first terminal, a second terminal connected to ground, and a third terminal, said light emitting element emitting light when said light emitting element turns on;

a driver circuit connected to the first terminal, said driver circuit supplying a drive current to said light emitting element when said light emitting element turns on; and a control circuit connected to the third terminal and applying a control voltage to the third terminal, wherein the control voltage is higher than a voltage appearing at the second terminal when said light emitting element remains on;

wherein said control circuit includes a first switch element and a second switch element that are of a first semiconductor conductivity type, and a third switch element of a second semiconductor conductivity type, the first switch element including fourth and fifth terminals, the second switch element including sixth and seventh terminals, and the third switch element including eighth and ninth terminals, wherein the fourth terminal is connected to a power supply, the ninth terminal is connected to ground, the fifth and sixth terminals are connected to the third terminal, and the seventh terminal is connected to the eighth terminal.

* * * * *